United States Patent [19]

Urmston

[11] 4,124,669

[45] Nov. 7, 1978

[54] AERATED CONCRETE PROCESS

[76] Inventor: Charles W. B. Urmston, 9 Thurloe St., London, England

[21] Appl. No.: 703,163

[22] Filed: Jul. 7, 1976

Related U.S. Application Data

[63] Continuation-in-part of Ser. No. 358,436, May 8, 1973, abandoned.

[51] Int. Cl.[2] ..... B28B 1/14

[52] U.S. Cl. ..... 264/42; 264/51; 264/86; 264/160; 264/333; 264/336; 264/338; 264/DIG. 43

[58] Field of Search ..... 264/42, 333, 338, 51, 264/86, 160, DIG. 43, 336

[56] References Cited

U.S. PATENT DOCUMENTS

| | | | |
|---|---|---|---|
| 3,026,652 | 3/1962 | Helmerson | 264/42 |
| 3,236,925 | 2/1966 | Urmston | 264/42 |
| 3,397,260 | 8/1968 | Lamberton | 264/42 |

FOREIGN PATENT DOCUMENTS

| | | | |
|---|---|---|---|
| 1,315,065 | 3/1969 | U.S.S.R. | 264/42 |

*Primary Examiner*—Robert F. White
*Assistant Examiner*—John A. Parrish
*Attorney, Agent, or Firm*—Sughrue, Rothwell, Mion, Zinn and Macpeak

[57] ABSTRACT

The invention provides a process of producing lightweight concrete units, which may or may not be reinforced, which comprises making a mix including cementitious material, fine and, optionally, coarse aggregate, water and material for aerating the mix, preferably aluminium powder and alkali; inserting the mix into a mould and allowing the mix to set into a block in the mould; stripping the mould, and autoclaving the block. In this process, in accordance with the invention, the mix is inserted into the mould before the aeration of the mix is completed and without completely filling the mould, the mould is provided with a closure which allows gas but not solids to escape, and the mix is allowed to expand to fill the mould and set under pressure produced by its own aeration.

9 Claims, 3 Drawing Figures

AERATED CONCRETE PROCESS

This application is a continuation-in-part of application Ser. No. 358,436, filed 5-8-73, now abandoned.

This invention relates to light weight concrete, which may or may not be reinforced.

There are a number of ways of making concrete lighter. The degree to which this can be done is dependent on the method used. The following methods are known:

(a) "No-fines" concrete wherein a certain reduction in weight is obtained by leaving out the "fines" from the coarse aggregate and cement mixture, thus leaving voids in the concrete the general effect of which is to reduce its weight, from 150 lbs. per cubic ft. to approximately 135 lbs. per cubic ft.

(b) By the introduction of lightweight aggregates in place of the heavy stone and gravel aggregates commonly used. The extent to which the weight of the resulting concrete is reduced is related to the weight of the replacement lightweight aggregate. Examples of lightweight aggregate are pumice, foamed slag, furnace clinker, expanded clay, slate or slate and sintered pulverized fuel ash.

By these methods the density range is somewhere between 140 lbs. per cubic ft. down to 70 lbs. per cubic ft. nominal density.

No departure from standard techniques is involved for methods (a) and (b) above: the ingredients are added in normal cement mixers and the concrete placed in the normal way and vibrated to obtain the correct degree of compaction.

Lightweight structural concrete made by the above methods has the advantage that it can be poured to virtually any height within moulds or shutters without the height of the mould having any detrimental effect. This has a particularly useful application in the pouring of storey high partitions in vertical casting in gangs of vertical panel moulds.

Where it is desired to reduce the density of the concrete even further than by the above methods (a) and (b), it is common practice to introduce air either as a preformed foam or by using chemical foaming agents such as aluminium powder in conjunction with an alkali. By such methods it is possible to produce lightweight concrete with a density of 30 lbs. per cubic ft. to 75 lbs. per cubic ft. Methods of making aerated concrete are described in British patent specifications Nos. 648,280 and 1,040,442, the latter (which is equivalent to my U.S. Pat. No. 3236925) being preferred.

As has been described, there are no problems in making concrete lighter by replacing the heavy aggregates with lightweight aggregates and the like. There are, however, a number of disadvantages and problems which arise when attempts are made to produce a lighter concrete by the process of introducing air or gas. These can be summarised as follows:

(a) It is not possible to cast a material beyond a certain depth generally only about 2 ft., without the concrete setting non-homogeneously, with the result that it is useless.

(b) Owing to the expansion of the mass around the steel (assuming the concrete is reinforced), a gap tends to be left at the top of the steel reinforcement as the material rises around it, which is commonly known as 'shadow' which either destroys or greatly reduces the bond strength between the reinforcing steel and the concrete, thus limiting its performance and uses.

(c) It is a technically difficult problem to obtain homogeneity throughout the mass.

(d) Owing to the material rising like a loaf of bread in manufacture, a top crust of a scummy or aerated nature remains which has to be removed prior to further processing.

(e) In normal aeration processes as in British specification No. 648,280 it is not possible to incorporate lightweight aggregate satisfactorily as owing to the fluid state of the mass necessary prior to pouring into the moulds, the aggregate either floats to the top or sinks to the bottom but does not stay well and evenly distributed.

The process described in British specification No. 1,040,442 obviates the disadvantage (e) and minimizes the others.

In one important aspect the invention aims to minimise the above disadvantages and in particular to enable casting of aerated concrete to a greater depth than has been possible heretofore.

With this aim in view, the invention provides, in a process of producing lightweight concrete units which comprises the steps of:

making a mix including cementitious material, aggregate, water and material for aerating the mix;

inserting the mix into a mould and allowing the mix to set into a block in the mould, and stripping the mould, and autoclaving the block, the improvement that:

the mix is inserted into the mould before the aeration of the mix is completed and without completely filling the mould, the mould being disposed with the storey-high dimension vertical;

a perforated rigid closure is provided over the whole area of the top of the mould and filter material under it whereby to allow gas and liquid, but not solids, to escape; and the mix is allowed to expand to fill the mould and set under pressure produced by its own aeration.

Preferably the mix is made by first introducing into the water of the mix at a predetermined temperature, which may be in the range 35° to 75° C. and is preferably about 65° C., an "activating agent" consisting of aluminium powder of the type known as "atomised" together with alkali and a catalyst and soap, all in predetermined amounts. The atomised aluminium powder is preferably of the size known as "120 dust" and sold by Alcan Industries Limited. Reaction between the aluminium and alkali starts as soon as the activating agent contacts the water. The water is then immediately introduced into the fine aggregate and cement in the mixer. If no coarse aggregate is required the mix is put into the mould when the reaction has advanced sufficiently.

If coarse aggregate is required, it is added to the mix in the mixer, say a minute or a minute and a half after the addition of water, when the mix has been brought to a state of aeration sufficient to support the coarse aggregate. Mixing is continued only until homogeneity is obtained, and the mix is then immediately put into the mould. The coarse aggregate may be ¾" to ¼" size and up to 60 lb./cu.ft. bulk density, though higher densities may be used if the sizes are reduced.

With the preferred process according to the invention the moulds may be filed to a considerable height, say 8 feet or more, without any appreciable lack of homogeneity. The whole height of the block can be used. Coarse aggregate of suitable type can be used without its separating. Reinforcement can be used without development of "shadow".

One unexpected advantage of the process is that good results can be obtained using pumice as aggregate, either as fine or coarse aggregate, or as both. Pumice is a low density material occurring naturally in enormous and readily accessible quantities. Hitherto it has not been used for high quality light weight concrete, largely because of relatively high water absorption and variability of composition. In the process of the present invention these characteristics are not found to have any significant detrimental effect on the product.

The bulk density of the pumice which is used in carrying out the invention can vary over the range 10 lb./cu.ft. to 35 lb./cu.ft. Pumice can form some or all of the fine aggregate in the mix and also some or all of the coarse aggregate if present.

The block produced according to the invention in the mould may be used as such, or it may be cut up, for example into slices. Previous lightweight concrete processes have involved the production of a substantial block which is cut into slices by multiple wires after the material has expanded and set, before autoclaving. Previous processes (apart from that of British patent specification No. 1,040,442) could not make use of coarse aggregate, and the cutting action was comparable to the cutting of cheese. This method of cutting would not work with coarse aggregate since the wires would tend to drag the larger particles through the material. For this reason, where the process according to the invention makes use of coarse aggregate and the block has to be divided, the block is sawn after autoclaving. Since the process according to the invention enables blocks to be made to a much greater height than previously it will often be possible to design the block for use as such rather than to divide the block as has hitherto been customary.

Various examples will now be given of mixes for use in carrying out the invention. The activating agent referred to in the examples is in each case a dry powder mixture made up as follows:

| | |
|---|---|
| Atomised aluminium powder (sold commercially under the designation "120 dust" by Alcan Industries Ltd) | 10 parts by weight |
| Sodium carbonate | 17.5 parts by weight |
| Sodium stearate | 2 parts by weight |
| Ferric oxide | 10 parts by weight |

In all Examples the coarse aggregate should have a sieve analysis generally as follows:

| SIZE OF SIEVE | % AGE PASSING |
|---|---|
| ¾ inch | 100 |
| ⅝ inch | 90 |
| ½ inch | 20 |
| ⅜ inch | 10 |
| ¼ inch | 5 |
| No. 7 | Trace |

"Leca" and "Aglite" are trade marks for commercially available sintered clay light weight aggregate, the former having about 25 lb./cu.ft. bulk density and the latter 34 lb./cu.ft. bulk density. Where used for coarse aggregate pumice is crushed to ⅜" nominal size, with some 80% held on a ½" sieve, and of 24 to 28 lb./cu.ft. bulk density.

"Ash" is fly ash, the residue of pulverized coal after combustion e.g. for electricity generation.

The cement is ordinary rapid-hardening Portland cement, (though as proposed in British specification No. 1,090,261 the cement can be "micron sized" with the reduction of quantity mentioned in that specification).

In the Examples the set volume and density refer to the filled mould. There is no waste.

EXAMPLE 1

| INGREDIENTS | AMOUNTS |
|---|---|
| Cement | 240 lbs. |
| Ash | 360 lbs. |
| Aglite | 375 lbs. |
| Activating Agent | 960 grams. |
| Water at 65° C | 29 Imperial Gallons |

The mixing time was 4.3 minutes and the set volume 14 cu.ft. The density of the product was 70 lbs./cu.ft.

EXAMPLE 2

| Ingredients | Amounts |
|---|---|
| Cement | 240 lbs. |
| Ash | 360 lbs. |
| Aglite | 350 lbs. |
| Activating Agent | 1450 grams |
| Water at 60° C | 41 Imperial Gallons |

The mixing time was 4.3 minutes and the set volume 19 cu.ft. The density of the product was 50 lbs./cu.ft.

EXAMPLE 3

| Ingredients | Amounts |
|---|---|
| Cement | 240 lbs. |
| Ash | 192 lbs. |
| Sand | 166 lbs. |
| Aglite | 350 lbs. |
| Activating Agent | 960 grams |
| Water at 65° C | 29 Imperial Gallons |

The mixing time was 4.0 minutes and the set volume 13.5 cu.ft. The density of the product was 70 lbs./cu.ft.

EXAMPLE 4

| Ingredients | Amounts |
|---|---|
| Cement | 168 lbs. |
| Ash | 336 lbs. |
| Leca | 422 lbs. |
| Activating Agent | 900 grams |
| Water to 65° C | 41 Imperial Gallons |

The mixing time was 4 minutes and the set volume 18.92 cu.ft. The density of the product was 50 lbs./cu.ft.

EXAMPLE 5

| Ingredients | Amounts |
|---|---|
| Cement | 240 lbs. |
| Ash | 360 lbs. |
| Leca | 280 lbs. |
| Activating Agent | 1000 grams |
| Water at 68° C | 39 Imperial Gallons |

The mixing time was 4 minutes and the set volume 17.6 cu.ft. The density of the product was 50 lbs./cu.ft.

EXAMPLE 6

| Ingredients | Amounts |
|---|---|
| Cement | 240 lbs. |
| Ash | 192 lbs. |
| Sand | 166 lbs. |
| Leca | 220 lbs. |
| Activating Agent | 700 grams |
| Water at 62° C | 29 Imperial Gallons |

The mixing Time was 4.5 minutes and the set volume 11.7 cu.ft. The density of the product was 70 lbs./cu.ft.

EXAMPLE 7

| Ingredients | Amounts |
|---|---|
| Cement | 168 lbs. |
| Sand | 336 lbs. |
| Leca | 422 lbs. |
| Activating Agent | 900 grams |
| Water at 65° C | 29.9 Imperial Gallons |

The mixing time was 3.5 minutes and the set volume 17.5 cu.ft. The density of the product was 53 lbs./cu.ft.

EXAMPLE 8

| Ingredients | Amounts |
|---|---|
| Cement | 168 lbs. |
| Ash | 336 lbs. |
| Pumice (coarse aggregate) | 422 lbs. |
| Activating Agent | 900 grams |
| Water at 65° C | 41 Imperial Gallons |

The mixing time was 4 minutes and the set volume 18.92 cu.ft. The density of the product was 50 lbs./cu.ft.

EXAMPLE 9

| Ingredients | Amounts |
|---|---|
| Cement | 240 lbs. |
| Ash | 360 lbs. |
| Pumice (coarse aggregate) | 280 lbs. |
| Activating Agent | 1000 grams |
| Water at 68° C | 39 Imperial Gallons |

The mixing time was 4 minutes and the set volume 17.6 cu.ft. The density of the product was 50 lbs./cu.ft.

EXAMPLE 10

| Ingredients | Amounts |
|---|---|
| Cement | 240 lbs. |
| Pumice Dust | 300 lbs. |
| Pumice (coarse aggregate) | 280 lbs. |
| Activating Agent | 1000 grams |
| Water at 68° C | 42 Imperial Gallons |

The mixing time was 4 minutes and the set volume 16.5 cu.ft. The density of the product was 49 lbs./cu.ft.

EXAMPLE 11

| Ingredients | Amounts |
|---|---|
| Cement | 240 lbs. |
| Pumice Dust | 336 lbs. |
| Pumice (coarse aggregate) | 220 lbs. |
| Activating Agent | 150 grams |
| Water at 67° C | 30 Imperial Gallons |

The mixing time was 4 minutes and the set volume 11.4 cu.ft. The density of the product was 70 lbs./cu.ft.

EXAMPLE 12

| Ingredients | Amounts |
|---|---|
| Cement | 240 lbs. |
| Sand | 360 lbs. |
| Pumice | 220 lbs. |
| Activating Agent | 1000 grams |
| Water at 66° C | 48 Imperial Gallons |

The mixing time was 4.1 minutes and the set volume 16.0 cu.ft. The density of the product was 51 lbs./cu.ft.

In the usual case where the mix is poured into open moulds, the control the pressure developed in the mould to be appropriate for a given height of mould, pouring the mix into the mould is stopped with the mix at a specific distance from the top. A lid is then immediately closed on the mould tight enough to prevent the concrete from coming out, but such that the trapped air can vent as the concrete expands.

Preferably the mould lid consists of perforated wood, metal or plastic plates with holes as will be described and a filter paper or other filter material held in place thereby. The perforations and filter material extend over the whole area of the top of the mould. By these means it is possible for the excess gas and water to be expelled from the mix so that (a) the mould does not burst and (b) the maximum water comes out through the filter media via the holes in the supporting mould lid with greatly enhanced benefits to the properties of the product.

The removal of excess water is most valuable for this reason. It is known that the water/cement ratio is critical in all concrete work. In order to give the mix to flow adequately a given quantity of water has to be used, both in normal dense concrete and more particularly in aerated concretes and in the lightweight aggregate concretes of the present invention. The minimum water for adequate fluidity of the mix is greater than is absolutely necessary for hydration. It is known in the industry that particularly in the production of dense concrete slabs (e.g. paving stones) it is possible to get rid of this excess water by applying a very high pressure in a press, which increases the concrete density. In this preferred feature of the invention some excess water is removed from the concrete by the pressure developed by its own aeration without increase of density.

The concrete expands in the mould due to the effect of the aluminium powder reaction until the mould is filled: this occurs at a point in time considerably before expansion would have stopped if the mould had been open. This final expansion is resisted by the strength of the mould so that the whole mass is put under pressure. The amount of pressure is determined relative to the desired final density of the material and the height to which it has to be poured. The time of pouring the mix, (i.e. the amount of aeration still left,) the depth to which the concrete is poured and the arrangement used to allow gas and water to escape will be determined empirically.

The selection of the aluminium powder and other chemicals, and the temperatures used in the process is such that a very fast expansion is achieved in the mixer in order to make it possible to support the aggregates and also to make it possible to achieve before pouring the mix such a high percentage of the total expansion that the mould can be filled to a greater depth than is possible in hitherto standard aerated concrete techniques. The final expansion then develops pressure in the mould and this continues for longer than usual with standard techniques in open moulds so that the pressure is kept up within the mould until the material has set, thus improving the bond between the material and any reinforcing steel, and also between the fine material and the coarse aggregates. Without this final expansion there would be a tendency for the material to retract from the lid; if this happens to any extent the product is rendered useless.

In the preferred embodiment of the invention above described the concrete is poured from the top into moulds, which are subsequently closed. If desired, the concrete can be pumped into a closed mould, e.g. from the bottom, much as plastics is injected in the injection moulding technique.

BRIEF DESCRIPTION OF THE DRAWINGS

One example of mould for use in carrying out the invention is shown in the accompanying diagrammatic drawing, in which.

DESCRIPTION OF PREFERRED EMBODIMENT

Figure 1:
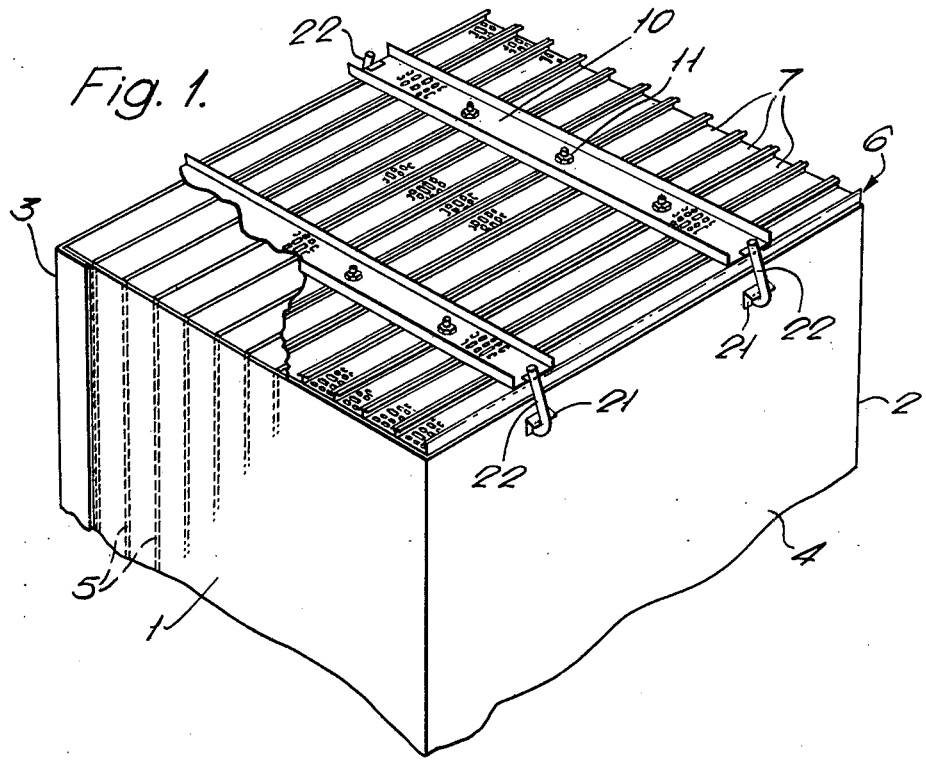
FIG. 1 is a perspective view of the top part of the mould.
Figure 2:
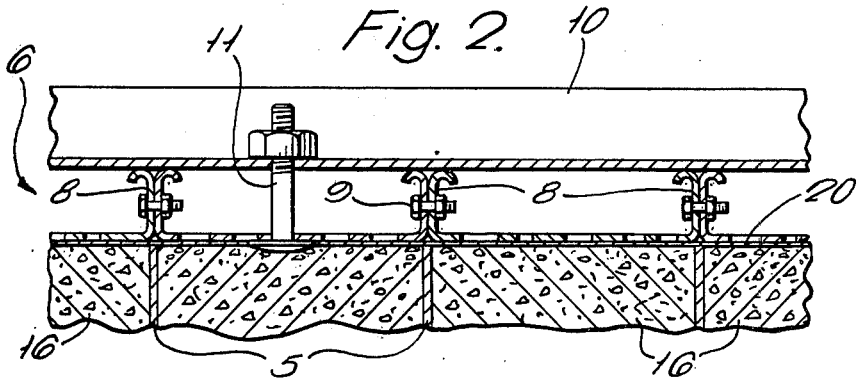
FIG. 2 is a section of part of the lid of the mould, with portions underneath.

Referring to the drawings, the composite mould comprises vertical sides, 1, 2, and ends 3, 4 and removable vertical partitions 5: the mould has also a base which is not shown. All these members are imperforate.

The mould has a lid designated generally 6 comprising a series of parallel strip-like members 7 having turned up edges 8 secured side by side with bolts 9 and reinforced by a pair of strip-like members 10 across the top secured by bolts 11. The strip-like members 7, 10 in the example shown are standard cable trays, but a specially made unitary lid can be provided if desired.

Figure 3:
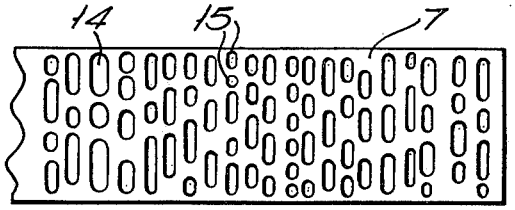
FIG. 3 is a plan view of a portion of the lid.

The members 7 have holes of various sizes from about $\frac{1}{4}'' \times \frac{3}{4}''$ oval-ended slots 14 to $\frac{1}{4}''$ diameter round holes 15, arranged as shown in FIG. 3. The hole sizes and arrangement can be varied over a wide range.

With the mould assembled apart from the lid 6, the mix is poured into the various compartments 16 between the partitions 5 until near the top. The distance below the top at which pouring is stopped is determined by trail for given conditions. By way of example, in a mould 9 feet high, pouring may be stopped 6" from the top. In a very shallow mould, say 6", pouring could stop 1" from the top. The gap at the top would be larger for deeper moulds, but not proportionally so; it will also depend on the density aimed for in the concrete, the lighter concrete giving off more gas.

A filter paper 20 is laid on the top of the mould and the lid 6 clamped on, for example with the aid of lugs 21 on the end walls 3, 4 and catches 22 on the reinforcement members 10. Various types of filter paper can be used. A preferred form of paper is that supplied by W. H. Anderton & Sons Limited of Manchester, England, under the designation Type MG Concrete Slab Paper. This paper is not re-usable. It is allowed to adhere to the block and disappears during treatment of the block in the autoclave.

The strength required will depend on the pressure developed, which may be up to 10 lbs./sq.in., and the size of the holes in the lid.

When the concrete has set the lid is removed, and the blocks lifted out or otherwise removed. Each partition with adjacent block may be lifted separately after relaxation of pressure from end and side walls.

The following benefits are achieved by the process described:

(a) Since the concrete can be homogenous up to heights of 10 feet, large unitary panels can be made which hitherto would have to be made, if at all, out of a number of individual "planks" joined together.

(b) In the normal aerated concrete considerable technical difficulty and much expertise is required to obtain a constant density to produce a homogeneous material even in moulds up to two feet deep. It is necessary to remove the top several inches from the cast material after it has set. The method just described improves homogeneity, even over much greater depth, and obviates the need for cutting off the top of the cast material.

(c) A known weight of material is placed in the mould, there is no wastage, and the final density of the material is entirely predictable.

(d) Vibration is unnecessary: the pressure generated in the mass compresses the material tightly around any reinforcing steel present, giving a good bond with the steel reinforcement, in contrast to the ordinary aerated lightweight concrete where the expansion around the steel upwards produces what is commonly referred to a shadow effect, i.e. a gap between the top of the reinforcing steel and the material which seriously reduces the bond strength of the material with any reinforcing steel. The compression of the material around the reinforcing rods also helps to resist corrosion of the steel.

(e) The pressurising of the concrete in setting not only increases the bond strength between the material and any steel reinforcement, but it has the same effect in compressing the material into and round the lightweight aggregate which tends to improve the physical properties of the concrete. Furthermore, where it is desired to profile or cast a pattern for decorative or other reasons into the unit the expansion under pressure ensures a clear cut and accurate result.

I claim:

1. A process of producing lightweight concrete units which comprises the steps of:

making a dry mixture of aluminium powder, alkali, catalyst for aeration and metal soap;

introducing the mixture into water at a temperature in the range of 35°–75° C.;

making a mix including Portland cementitious material and fine aggregate, and said water containing said mixture, the water containing said mixture being added to the mix immediately after introduction thereto of said mixture;

introducing coarse aggregate into said mix after aeration of the mix has begun and continuing mixing only for such time as to achieve homogeneity;

placing said mix into a mold;

allowing the mix to said in the mold;

stripping the mold and autoclaving to cure the unit;

the improvement comprising employing a mold characterised by imperforate vertical sides, imperforate vertical ends, an imperforate base and a perforated closure over the whole area of the top of the mold with semi-porous filter material under said closure, to allow gas and liquid, but not solids to escape through said closure;

immediately after the introduction of said coarse aggregate into said mix and achievement of homogeniety, but before aeration of the mix is completed, pouring the mix into said mold without completely filling said mold, but filling it sufficiently to allow expansion of the mix to completely fill the mold, whereby the mix expands to fill the mold and sets under pressure produced by its own aeration.

2. A process as claimed in claim 1 to produce a plurality of units wherein the mix is poured into a deep open-topped mold having removable vertical walls, portions of the mix being separated from one another by the removable vertical walls; the mold is closed by a perforated plate forming a unitary lid for the mold, said lid supporting filter material on its underside; and the walls are removed when the mold is stripped to produce a plurality of units.

3. A process for producing a storey-high lightweight concrete slab in a vertically-disposed mold which comprises the steps of:

making a mix including Portland cement, fine and coarse aggregate, water, and material for aerating the mix, said material for aerating the mix including aluminium powder, alkali, catalyst for aeration and metal soap which are introduced by mixing water at a temperature in the range of 35°–75° C. with said material for aerating the mix and then immediately introducing the water containing said material for aerating the mix into the aggregate and cement;

placing said mix into a mold;

allowing the mix to set in the mold and stripping the mold and autoclaving to cure the unit;

the improvement which comprises employing a mold characterised by imperforate vertical sides, imperforate vertical ends, an imperforate base and a perforated closure over the whole area of the tip of the mold with semi-porous material under said closure, to allow gas and liquid, but not solids to escape through said closure; inserting said mix into said mold before the aeration of the mix is completed and without completely filling said mold but filling it sufficiently to allow expansion of the mix to completely fill said mold, said mold being disposed with the storey-high dimension vertical and allowing the mix to expand to fill the mold and set into a slab under pressure produced by its own aeration.

4. A process as claimed in claim 3 using fine and coarse aggregate, wherein the water is immediately introduced into the fine aggregate and cement and then, after aeration of the mix has begun, the coarse aggregate is added, further mixing being only such as the achieve homogeneity.

5. A process as claimed in claim 3, wherein the coarse aggregate is of lightweight type in the ¾" to ¼" size and up to 60 lb./cu.ft. bulk density.

6. A process as claimed in claim 5, wherein the slab is sawn into units after autoclaving.

7. A process as claimed in claim 3, wherein the mix is inserted by injection onto the mould from below.

8. A process as claimed in claim 3, to produce a plurality of units wherein the mix is poured into a deep open-topped mold having removable vertical walls, portions of the mix being separated from one another by the removable vertical walls; the mold is closed by a perforated plate forming a unitary lid for the mold, said lid supporting filter material on its underside; and the walls are removed when the mold is stripped to produce a plurality of units.

9. A process of producing lightweight concrete units which comprises the steps of making a dry mixture of aluminium powder, alkali, catalyst for aeration and metal soap; introducing the mixture into water at a temperature in the range of 35°–75° C.; making a mix including Portland cementitious material and fine aggregate, and said water containing said mixture, the water containing said mixture being added to the mix immediately after introduction thereto of said mixture; introducing coarse aggregate into said mix after aeration of the mix has begun and continuing mixing only for such time as to achieve homogeneity; placing said mix into a mold; allowing the mix to set in the mold; stripping the mold and autoclaving to cure the unit; the improvement comprising employing a mold characterized by vertical sides, vertical ends, a base and a perforated closure over the whole area of the top of the mold with semi-porous filter material under said closure, to allow gas and liquid but not solids to escape through said closure; immediately after the introduction of said coarse aggregate into said mix and achievement of homogeniety, but before aeration of the mix is completed, pouring the mix into said mold without completely filling said mold, but filling it sufficiently to allow expansion of the mix to completely fill the mold, whereby the mix expands to fill the mold and sets under pressure produced by its own aeration.

* * * * *